US006933430B2

(12) United States Patent
Oskorep

(10) Patent No.: US 6,933,430 B2
(45) Date of Patent: Aug. 23, 2005

(54) GUITAR PICK HOLDER MADE OF A FLEXIBLE MAGNETIC BODY

(76) Inventor: John Jeffrey Oskorep, 416 W. Briar Pl., Unit #3, Chicago, IL (US) 60657

( * ) Notice: Subject to any disclaimer, the term of this patent is extended or adjusted under 35 U.S.C. 154(b) by 47 days.

(21) Appl. No.: 10/348,056

(22) Filed: Jan. 21, 2003

(65) Prior Publication Data

US 2004/0074369 A1 Apr. 22, 2004

Related U.S. Application Data

(60) Provisional application No. 60/421,125, filed on Oct. 22, 2002.

(51) Int. Cl.[7] ..... G10D 3/16
(52) U.S. Cl. ..... 84/322; 84/320; 84/321
(58) Field of Search ..... 84/322, 320, 321

(56) References Cited

U.S. PATENT DOCUMENTS

| | | | | | |
|---|---|---|---|---|---|
| 3,181,410 | A | * | 5/1965 | Phillips | 84/322 |
| 3,595,118 | A | * | 7/1971 | Paxton | 84/322 |
| 4,135,431 | A | * | 1/1979 | Ferguson | 84/329 |
| 4,145,944 | A | * | 3/1979 | Helpinstill, II | 84/726 |
| 4,310,978 | A | | 1/1982 | Stern | |
| 4,372,186 | A | * | 2/1983 | Aaroe | 84/725 |
| 4,581,266 | A | * | 4/1986 | Magnotta | 428/32.8 |
| 4,785,708 | A | | 11/1988 | Vaughan | |
| 4,878,412 | A | * | 11/1989 | Resnick | 84/726 |
| 4,982,641 | A | | 1/1991 | Duhart | |
| 5,127,300 | A | | 7/1992 | Silverman | |
| 5,422,432 | A | * | 6/1995 | Lace | 84/726 |
| 5,464,948 | A | * | 11/1995 | Lace | 84/726 |
| 5,905,217 | A | * | 5/1999 | Byers | 84/322 |
| 5,920,023 | A | * | 7/1999 | Ravagni et al. | 84/485 R |
| 6,171,107 | B1 | * | 1/2001 | Milne | 433/189 |
| 6,215,052 | B1 | | 4/2001 | Giddens et al. | |

FOREIGN PATENT DOCUMENTS

| | | | |
|---|---|---|---|
| FR | 2577336 | | 8/1986 |
| GB | 1 468 561 | | 3/1977 |
| GB | 2 292 474 | | 2/1996 |
| JP | 355125800 | * | 9/1980 |
| JP | 2000276131 | | 10/2000 |

OTHER PUBLICATIONS

Web pages from http://www.stringitup.com/dunpick-hol.html printed on Jan. 10, 2003 regarding spring–loaded "Dunlop Pick Holder".

Web pages from www.magspec.com printed on Jan. 10, 2003 regarding ProMAG™ magnetic sheets and Paper-STEEL™ products.

Copies of front and rear packaging for Avery® product called "Ink Jet Magnetic Sheets" (3270).

Web pages from http://www.somervellguitars.com/kling–on.html printed on Jan. 20, 2003 regarding Kling–On™ Guitar Top Protectors.

* cited by examiner

*Primary Examiner*—Shih-yung Hsieh
(74) *Attorney, Agent, or Firm*—John J. Oskorep, Esq.

(57) ABSTRACT

In one illustrative example, a guitar pick holder is made of a thin, flat, and visually appealing flexible magnet which adheres to a front outside surface of a guitar. A guitar pick which is used with the holder is made of a synthetic material but also includes a magnetically receptive material (e.g. iron) formed on or within the synthetic material. The guitar pick is magnetically held against a front magnetic surface of the flexible magnet and is thereby carried with the guitar, even when it is subject to relatively strong forces of accelerative motion (i.e. when the guitar is physically handled or shaken).

45 Claims, 4 Drawing Sheets

GUITAR PICK HOLDER MADE OF A FLEXIBLE MAGNETIC BODY

CROSS-REFERENCE TO RELATED APPLICATION

This application claims priority to a U.S. patent application entitled "Magnetic Guitar Pick Holding System" having U.S. Ser. No. 60/421,125 and a filing date of Oct. 22, 2002, which is hereby incorporated by reference herein.

BACKGROUND

1. Field of the Invention

The present invention relates generally to the field of guitars and guitar picks, and more particularly to a guitar pick holder made of a flexible magnetic body for holding magnetically receptive guitar picks.

2. Description of the Problem

A guitar is typically played with a "guitar pick", which is used to strike or pluck strings of the guitar. Many guitar players carry a number of guitar picks with them as they are relatively small, easily lost, and inexpensive. However, it is often inconvenient to store or retrieve guitar picks. Guitar picks are typically carried in pants pockets and/or within guitar cases and need to be retrieved when the guitar is played. When a guitar is taken out of its guitar case, for example, a guitar pick must be retrieved from some location. Conversely, when a guitar is placed back in its case, the guitar pick must be stored somewhere. When a guitar player is playing and accidentally drops or intentionally tosses away the guitar pick, it is desirable to be able to quickly retrieve another one.

The appearance of guitars and guitar picks are also important to guitar players, and therefore it is preferable that any method used to hold or carry guitar picks does not detract from how these items look. Furthermore, any guitar pick holding system should be inexpensively made so that it may become commercially available and ubiquitous to a large number of consumers. Promotional techniques are also important in the industry.

Accordingly, what is needed is a guitar pick holding system that solves at least some of the aforementioned problems.

SUMMARY

Broadly, the present application is directed to a guitar pick holder made of a flexible magnetic body. The flexible magnetic body has a rear adhering surface for adhering to a surface of a guitar and a front magnetic surface for magnetically holding a guitar pick. The guitar pick for use with the guitar pick holder is made of a synthetic material (e.g. plastic) but also includes a magnetically receptive material (e.g. metal such as iron).

The flexible magnetic body is preferably thin, flat, and formed into a decorative shape to provide a visually appealing design for the guitar. A layer of coloring and/or design may be formed over the front magnetic surface. This layer could be printed directly on the front magnetic surface, or alternatively on a layer of paper or vinyl which covers the front magnetic surface. The rear adhering surface is preferably a static cling vinyl surface, but in other embodiments it may be an adhesive surface or a magnetic or metal surface which is magnetically receptive. A removable backing sheet may be provided to cover the rear adhering surface, and removed before the use of the flexible magnetic body.

DETAILED DESCRIPTION OF THE PREFERRED EMBODIMENTS

Figure 1:
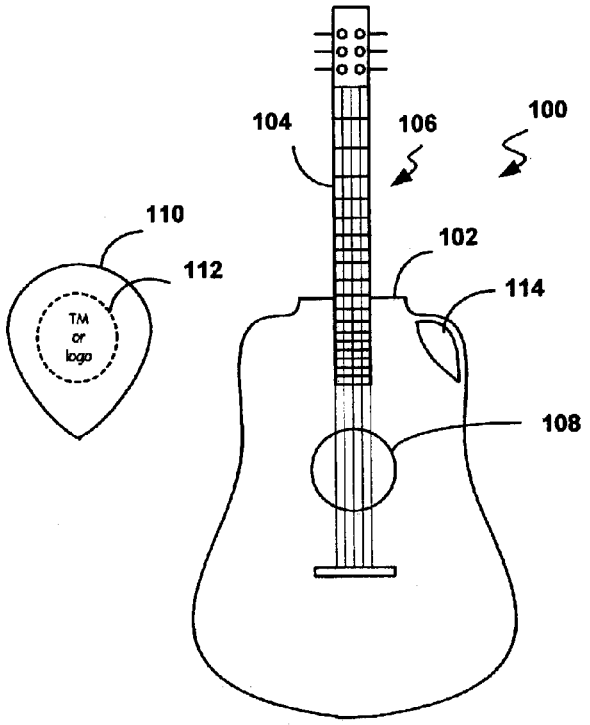
FIG. 1 is an illustration of a guitar with a guitar pick holding system which includes a flexible magnet and a guitar pick having a magnetically receptive material.

FIG. 1 is an illustration of a guitar 100 and a guitar pick 110 for use in connection with a guitar pick holder of the present application. Guitar 100 is a conventional acoustic guitar having a guitar body 102, a neck 104, a sound hole 108, and a plurality of guitar strings 106 (six in total). Guitar 100 may alternatively be an electrical guitar, such as a 6-string electric guitar or a bass guitar. Guitar body 102 is typically made of wood, but could be made of other suitable materials and include a lamination. Typically, guitar body 102 has a transparent or translucent gloss finish. The plurality of guitar strings 106 are typically made of steel, some of which may be wound with nickel.

Guitar pick 110, which is shown in FIG. 1 in enlarged view relative to guitar 100, is generally made of a flexible or resilient synthetic material, such as a plastic (e.g. nylon, delrin, tortex, celluloid, acetal, etc.). In this application, however, a magnetically receptive material 112 is also formed on or within guitar pick 110. Magnetically receptive material 112 is any suitable material that is attracted by magnetic forces, and includes materials such as a metal (e.g. iron, nickel, cobalt, etc.), a metal alloy, a magnetic material, and others.

A guitar pick holder of the present application is made of a flexible magnet 114 which is used to magnetically carry guitar pick 110. Flexible magnet 114 has a rear adhering surface for use in adhering to a surface of guitar body 102, and a front magnetic surface for use in magnetically carrying guitar pick 110.

In general, a flexible magnet is a magnet that is flexible. Rubber or plastic is generally used in combination with magnetic material (e.g. ferrite magnetic powder) for making such a flexible magnet. Integrally formed together, these materials are typically used to make common "refrigerator" magnets. As an example, a flexible rubber magnet is basically a composite material which combines ferrite magnetic powder and compound rubber. Due to its characteristics, a rubber magnet can be easily formed into any complicated shape. Unlike a hard ferrite magnet which is normally fragile against to shock, a rubber magnet is flexible and not easy to break or crack. It may be manufactured with appropriate flexibility and cut into any size with a knife or scissors (or die cut) to meet a specific requirement. Flexible magnetic sheets, with or without adhering backing surfaces, may be obtained from any suitable manufacturer or company such as from Magnetic Specialty Inc. having offices at 707 Gilman Street, Marietta, Ohio, 45750, USA.

Figure 2:
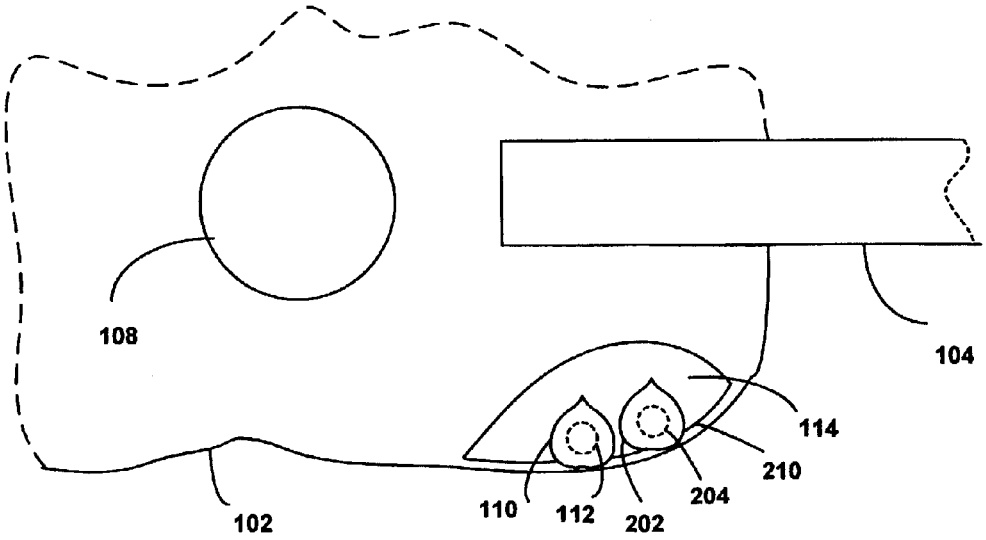
FIG. 2 is a close-up illustration of the guitar pick holding system of FIG. 1 in use with the guitar.

In FIG. 2, a close-up illustration of the guitar pick holding system of FIG. 1 in use with guitar 100 is shown. As shown, guitar pick 110 is held and carried over the outside front surface of guitar body 102 due to its magnetic attraction to flexible magnet 114, which is adhered to the guitar's front surface. This remains true even when the guitar is held in the position shown (i.e. guitar pick 110 being subject to downward gravitational forces) and even when it is subject to relatively strong forces of accelerative motion (i.e. guitar body 102 is physically handled or shaken). Advantageously, the magnetic forces provided by flexible magnet 114 are sufficiently large enough to magnetically carry guitar pick 110 with guitar body 102 but also sufficiently small enough so as not to interfere with any electronics used in connection with the guitar.

Preferably, flexible magnet 114 is positioned along a front bottom edge (right-handed perspective) above sound hole 108 of guitar 100, as shown in FIGS. 1 and 2. However, any suitable areas of attachment may be utilized. FIG. 2 also shows that additional guitar picks 202 having magnetically receptive material 204 may be included in the system. Preferably, flexible magnet 114 is thin (e.g. less than 5 mm or 0.2 inches in thickness) and has a length of between about 7.6–12.7 cm (between about 3–5 inches) to simultaneously accommodate a number of different guitar picks. Preferably, flexible magnet 114 has sufficient flexibility to maintain conformity to curved surfaces of guitar body 102 (e.g. curved side edges) if desired or needed.

Figure 3:
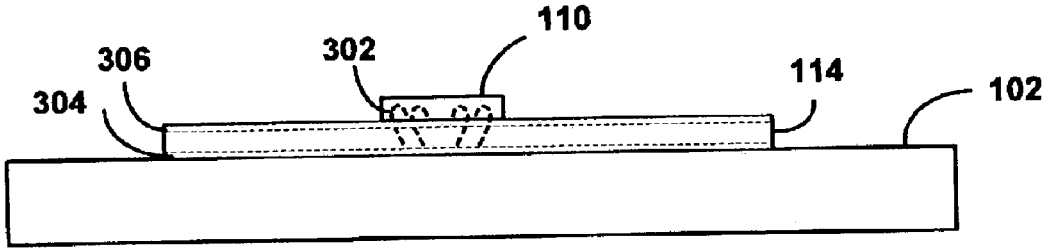
FIG. 3 is a cross-sectional view of the guitar pick holding system of FIGS. 1–2.

FIG. 3 is a cross-sectional view of the guitar pick holding system on guitar body 102 of FIG. 2. Thicknesses and relative thicknesses of the materials are exaggerated in FIG. 3 for illustrative purposes only. As shown, an adhering layer 304 is provided on a first surface of flexible magnet 114 opposite a second surface which provides a magnetic field 302 for attracting guitar pick 110. Adhering layer 304 provides for a semi-permanent attachment of flexible magnet 114 to guitar body 102. The rear adhering surface of flexible magnet 114 is preferably flat so that it conforms and adheres well to a variety of non-planar surfaces (e.g. curved side edges) as well as planar surfaces of a guitar body 102.

Preferably, adhering layer 304 is a static cling vinyl layer. This static cling vinyl layer may be adhesively attached to the rear surface of flexible magnet 114. Static cling vinyl is typically used for decorative purposes, such as for seasonal window graphics, signs, decals, or protective masking applications. Static cling vinyl is a special formulation of polyvinyl chloride (PVC) to which a large amount of plasticizer (a liquid) has been added. This highly plasticized formulation is very pliable. The vinyl is typically calendered to give it a smooth finish. When such film is applied to a smooth glossy surface (e.g. a guitar body), it adheres firmly without the need for an adhesive. Because there is no adhesive, application is very easy and it can be removed and reapplied nearly indefinitely.

Such static cling vinyl materials may be obtained from any suitable manufacturer or company, such as from Beacon Graphics having offices at 189 Meister Avenue, Somerville, N.J., 08876, USA. Although a particular formulation for static cling vinyl has just been described, other formulations may exist or be devised and the term "static cling vinyl" is intended to include such other alternative formulations which achieve the same results. Also, it is contemplated that the flexible magnet materials and static cling vinyl materials could be integrally formed or blended together in the same flexible magnetic body.

Some guitar surfaces have a nitrocellulose lacquer, which may be marred by plasticized PVC. Thus, in an alternate embodiment, adhering layer 304 of flexible magnet 114 is an adhesive layer. The adhesive may be a heavy adhesive or light temporary adhesive, and preferably one which leaves no adhesive residue (e.g. an adhesive which provides for reapplication and repositioning, such as a Post-It™ notes type adhesive by Spencer Silver) and provides an impermanent bond. Most manufacturers typically provide flexible magnetic sheets with an optional adhesive backing. More particularly, a low-tack micro-voided adhesive, called Supercling, is available from Plastiprint, Inc. of 445 Union Boulevard, Suite 209, Lakewood, Colo., 80228 USA. In yet another alternate embodiment, adhering layer 304 includes metal or magnetic material, which provides flexible magnet 114 with a magnetic attraction to a guitar body which has a metal or magnetic material surface.

Figure 4:
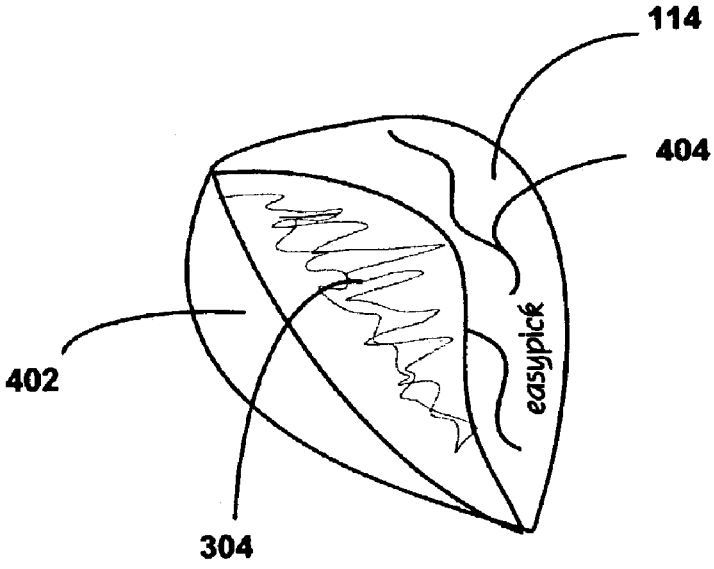
FIG. 4 is a perspective view of the flexible magnet which has a removable backing sheet which covers an adhering surface thereof.

As shown in the illustration of FIG. 4, flexible magnet 114 may also be provided with a removable backing sheet 402 over adhering layer 304 which is removed prior to attachment of flexible magnet 114 to guitar body 102. This removable backing sheet 402 is provided especially where adhering layer 304 includes a static cling vinyl or adhesive surface.

Referring back to FIG. 3, similar to the rear adhering surface, the front magnetic surface of flexible magnet 114 is preferably flat A flat front magnetic surface provides a good "sliding" action for easy removal of guitar pick 110 (e.g. the thumb may press and slide the pick off the edge of guitar body 102, where it is captured between the thumb and index finger). In the case where the front magnetic surface is formed to be flat, there may be a concern that guitar pick 110 will tend to slide off of guitar body 102 due to forces of gravity or accelerative motion (e.g. sudden guitar movements). However, magnetic field 302 over this surface is made sufficient such that guitar pick 110 normally remains held against flexible magnet 114 even when guitar body 102 is physically handled and shaken. Although magnetic forces 302 provided by flexible magnet 114 are sufficiently large enough to magnetically hold guitar picks in this manner, they are also sufficiently small enough so as to not interfere with any electronics used in connection with the guitar.

As shown in FIG. 3, a layer 306 of printed coloring and/or design (and/or a gloss finish) may be provided over the front magnetic surface of flexible magnet 114. A brand name may also be provided on the viewable surface, as shown in FIG. 4, which may additionally or alternatively include a visual design 404 or graphics image, a company name, a company logo, a band name, a band logo, or a band player's name. To provide such a layer of coloring, design, and/or text, any suitable technique may be used such as screen printing, label printing, offset printing, or colored laminates including vinyl or paper. As a preferred example, a black or white glossy vinyl "sticker" material may be provided on the front magnetic surface of flexible magnet 114. As another preferred example, a holographic "sticker" material may be formed or cut to fit the front magnetic surface. Such holographic materials are available from manufacturers or companies such as Amagic Holographics, Inc. of Irvine, Calif., U.S.A. As even another preferred example, a wood grain (e.g. maple or spruce) print may be provided on a vinyl or paper material formed or cut to fit the front magnetic surface, which is more suitable for acoustic guitars. Preferably, the color or design provided on the surface of flexible magnet 114 is the same or similar color or design provided on each surface of guitar pick 110. If a holographic sticker material is used, for example, the same or a similar holographic surface is provided on each surface of guitar pick 110.

Reference is now made generally to FIGS. 1–4 in combination. It is preferred that flexible magnet 114 be relatively thin. When flexible magnet 114 is kept thin, its front magnetic surface remains relatively flush with the surface of guitar body 102 so that guitar picks may be easily handled. For example, when guitar pick 110 is pressed to be slid off the edge of flexible magnet 114, it may get further slid along the front surface of guitar body 102 (or its edge) until it is captured by the fingers of the guitar player. Also, since flexible magnet 114 is so thin, when guitar pick 110 is pressed on an edge of flexible magnet 114 with the front surface of guitar body 102, it tilts with a relatively small angle so as maintain sufficient magnetic attraction with the front magnetic surface of flexible magnet 114 (i.e. it tends not to "pop" off when so depressed). A thin flexible magnet 114 also has a tendency to stay clear of obstructions which may jar guitar pick 110 and/or flexible magnet 114 off of guitar body 102. A thin flexible magnet is preferably sufficiently flexible such that it easily maintains conformity to curved surfaces (e.g. side edges) of a guitar body, even when the rear adhering layer is relatively weak (e.g. static cling vinyl). Finally, a thin constitution also helps provide flexible magnet 114 with the appearance of a decorative "decal" for decorating the front surface of guitar 100.

A thin flexible magnet is one that has a thickness of about 5 millimeters or less (about 0.2 inches or less). More particularly, it is preferred that flexible magnet 114 has a thickness of 1 millimeter or less (about 0.04 inches or less), or a thickness of 0.5 millimeters or less (about 0.02 inches or less). It is most preferred, however, that flexible magnet 114 has a thickness of about 0.3 millimeters or less (about 0.012 inches or less). Alternatively, a thickness of between about 0.254 millimeters or less (about 0.010 inches or less) may be suitable. It has been observed that, if flexible magnet 114 is made too thin, its edges or corners tend to curl up over time (several days or weeks) when a relatively weak adhering layer (e.g. static cling vinyl) is utilized. Conversely, if flexible magnet 114 is made too thick it becomes less flexible to maintain conformity over time to curved surfaces, as it tends to "pop off" when a relatively weak adhering layer (e.g. a static cling vinyl layer) is utilized. It has been determined that flexible magnet 114 having a thickness that is greater than 0.254 mm (or 0.010 inches), say approximately 0.3 mm (or 0.012 inches), provides a good tradeoff and alleviates these concerns when static cling vinyl is used. A slightly thicker flexible magnet 114, say approximately 0.38 mm (or 0.015 inches), may provide better attraction when covering flexible magnet 114 and guitar pick 110 with vinyl laminates.

Such thin flexible magnetic material may be obtained from, for example, Magnetic Specialty, Inc. mentioned earlier. ProMAG® magnetic sheets may be obtained for this application, with thicknesses ranging from 0.25 mm (0.010 inches) to 1.5 mm (0.060 inches). These sheets may be obtained with or without laminates such as vinyl, paper, or adhesive, colored or uncolored, and used in the present application. ProMAG® is a registered trademark of Magnetic Specialty, Inc.

Although flexible magnet 114 may be formed with any suitable length and width, it is preferred that flexible magnet 114 have a length of between about 6.35 centimeters (about 2.5 inches) to 11.43 centimeters (about 4.5 inches), and a width of between about 1 centimeter (about 0.4 inches) to 2.5 centimeters (about 1 inch). Most preferably, flexible magnet 114 has a length of about 8.9 centimeters (about 3.5 inches) and a width of about 1.5 centimeters (about 0.6 inches), suited to fit to most electric guitars along their narrow bottom "handle" near where a guitar player's fingers generally rest. With the most preferred length and width, flexible magnet 114 has a surface area sufficient to hold at least three guitar picks. Note that the width of flexible magnet 114 need not (and preferably does not) cover the entire surface area of guitar pick 110; the surface area of flexible magnet 114 may cover only between about 50%–80% of each guitar pick 110. For example, flexible magnet 114 may cover about 75%, 66%, or 50% of the surface area each guitar pick 110.

Figure 5:
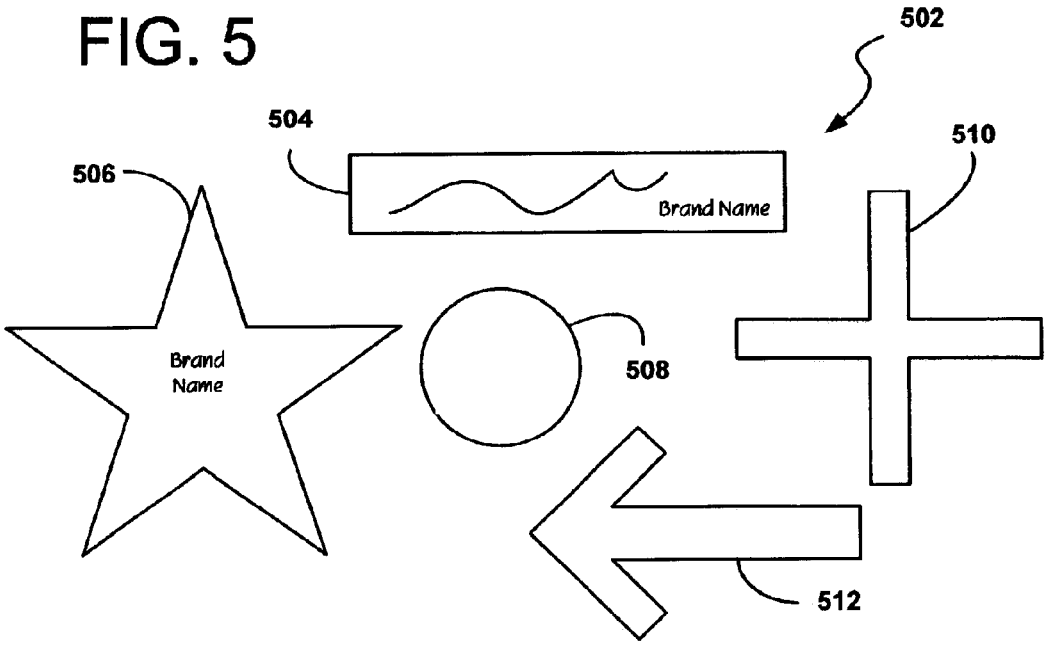
FIG. 5 is an illustration of a plurality of flexible magnets with different predetermined decorative shapes.

It is also desired that flexible magnet 114 take on a variety of visually appealing shapes, styles, and colors. In this case, flexible magnet 114 may be viewed as a decorative design for a front surface of a guitar (which may include a printed decorative coloring or design). FIG. 5 is an illustration of a plurality of flexible magnets 502 with different predetermined shapes, such as a rectangle 504, a star 506, a circle 508, a cross 510, and an arrow 512. Other shapes may be provided, such as a diamond, one or more footprints, a lightning bolt, an Shape, a Z-shape, an arc, an ellipse, etc. The shape may be in the form of a pickguard of a guitar, and be used for such purpose. Preferably, flexible magnets 502 are either white or black. Other suitable colors may be used as well, such as the color red, yellow, blue, green, etc. Flexible magnets 502 may be sized approximately as shown in FIG. 5. Each of these flexible magnets 502, as described above, has an adhering layer on a rear surface (with a removable backing sheet which covers the adhering layer) and a front surface which provides a magnetic field (and preferably including a coloring/design and/or glossy layer). Thus, if the flexible magnet is very thin and has a decorative shape, it appears to be a cosmetic "decal" or design on the front surface of a guitar. Flexible magnets 502 may be attached anywhere on the guitar (or other objects such as guitar cases, guitar straps, etc.) for decorative design as well as for holding guitar picks.

With reference back to FIG. 2, in one particular embodiment flexible magnet 114 has an edge 210 formed with an arcuate shape which conforms to an arcuate edge along a front surface of a typical acoustic guitar body 102. With such shaping, flexible magnet 114 appears to "blend" into guitar 100 as part of the guitar's intended design. This shape will also advantageously conform to the similarly formed adjacent corner along the front surface of acoustic guitar body 102, which is important since many acoustic guitars have a "cutaway" along the corner shown in use in FIG. 2. In an even more particular embodiment, flexible magnet 114 has an edge 210 which is formed with an arcuate shape that is symmetrical, so that it conforms and fits in the same manner on either arcuate corner of the front surface of acoustic guitar 100.

Figure 6:
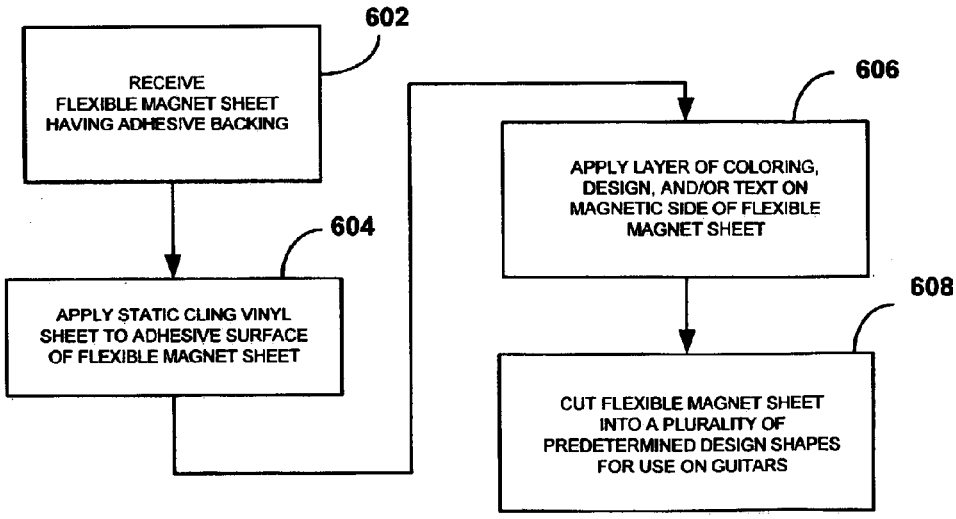
FIG. 6 is a flowchart which describes one method of making a guitar pick holder described herein.

FIG. 6 is a flowchart which describes one method of making a guitar pick holder with a flexible magnetic body. This method may be performed on a mass scale to provide a large number of flexible guitar magnets, or on a small scale so that individuals can custom make their own designs (e.g. band names and/or logos).

A flexible magnetic sheet having a magnetic surface and an adhesive surface opposite the magnetic surface is received (step 602 of FIG. 6). This flexible magnetic sheet has a surface area that is larger than the surface area of the resulting flexible guitar magnet(s). For example, the flexible magnetic sheet may have a length and width of about or at least 8.5"×11" (i.e. at least about 21.6 cm×27.9 cm). Such flexible magnetic sheets are widely available and are commonly used to create custom "refrigerator" type magnets. The flexible magnetic sheet may have a thickness which is the same as the flexible magnets described above in relation to FIGS. 1–5.

The flexible magnetic sheet has a removable backing sheet which temporarily covers the adhesive surface. This removable backing sheet is removed and a static cling vinyl sheet is applied to the adhesive surface (step 604 of FIG. 6). The static cling vinyl sheet has a surface area that is substantially the same as, or is comparable to, the surface area of the flexible magnetic sheet. Thus, a single sheet of flexible magnetic material and static cling vinyl is made. It is noted that steps 602 and 604 may be combined, simply such that a flexible magnetic sheet having a rear static cling vinyl surface is received. This sheet may be referred to as a flexible magnetic sheet having a static cling vinyl laminate.

A layer of coloring, design, and/or text, is then provided on the magnetic surface of the flexible magnetic sheet (step 606 of FIG. 6). Any suitable designs and/or colors may be used. Black and white colors are preferred, and custom printed band names may be provided. As alternatives, for example, a holographic image or a wood grain image may be provided. Step 606 may be performed in a few different ways. The coloring, design, and/or text may be provided or printed directly on the magnetic surface of the flexible magnetic sheet. Alternatively, a layer of paper or vinyl may be provided with or printed on with the appropriate coloring, design, and/or text, and thereafter adhesively attached to the magnetic surface of the flexible magnetic sheet. For large scale production, a number of the same or different colorings and/or designs are provided on the same magnetic sheet, so that a plurality of flexible guitar magnets can be made from the same sheet For a custom-made individual application, a sticker sheet which is ink-jet compatible and sized to be received in a conventional computer printer (e.g. 8.5"×11" or other) (i.e. 21.6 cm×27.9 cm or other) is provided for printing on and thereafter adhesively attaching to the magnetic side of the flexible magnetic sheet.

The flexible magnetic sheet is then cut into one or more predetermined design shapes (step 608 of FIG. 6). For example, see FIG. 5. Preferably, the shapes are different than standard shapes of a square, rectangle, or circle. For example, it is preferred that the shape be a custom shape or a star, a footprint, a lightning bolt, etc. For a large scale production, the flexible magnetic sheet may be die cut with a plurality of dies to simultaneously form a plurality of the same or different shapes from the same flexible magnetic sheet. For an individual custom-made application, the cut may be made from scissors and along edges of the printed layer coloring and/or design applied on the flexible magnetic sheet.

It is noted that the order of the steps described in FIG. 6 are preferred in the case where an individual is custom-making a guitar magnet, but this order is not as important for large scale production and may be varied. Summarizing that described in relation to FIG. 6, a method of making one or more guitar pick holders for a guitar includes the acts of receiving a flexible magnet sheet with a static cling vinyl layer for attaching to one side of the flexible magnet sheet; applying a layer of coloring or design to a magnetic surface of the flexible magnetic sheet; and cutting the flexible magnetic sheet into one or more decorative shapes to thereby form the one or more guitar pick holders. The act of applying the printed coloring or design layer may include the further act of applying a layer of printed paper or vinyl having the printed coloring or design.

Figure 7:
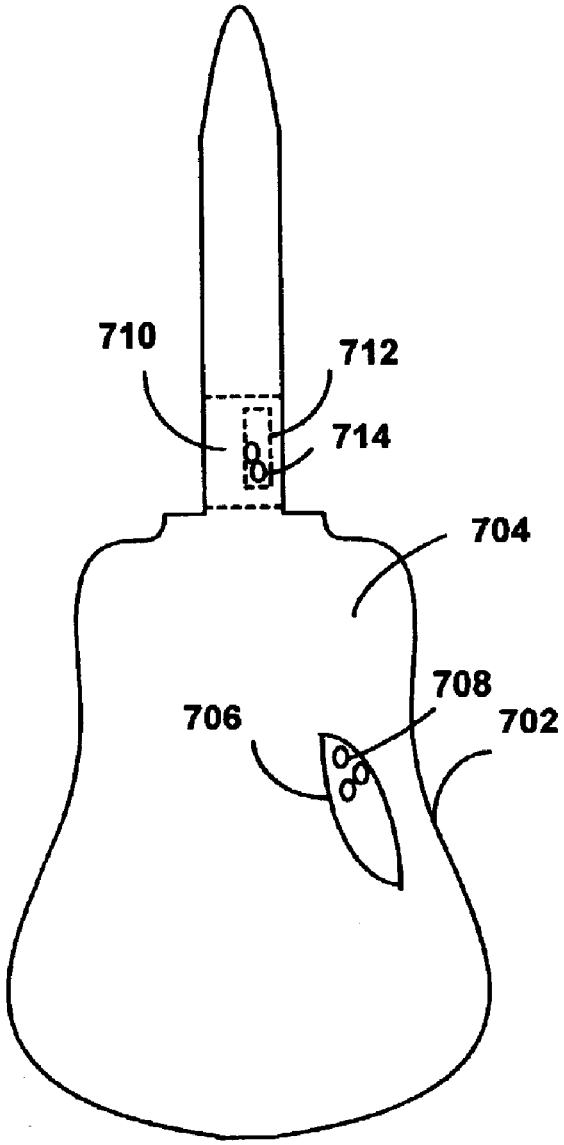
FIG. 7 is an illustration of a guitar case for carrying a guitar, where the guitar case includes a one or more flexible magnets adhered thereto.

FIG. 7 is an illustration of a guitar pick holding system for a guitar case 702 which is configured to carry a guitar (not visible in FIG. 9). Guitar case 702 has a body which includes an outside surface 704. Similar to those teachings described above, a flexible magnet 706 is adhered to outside surface 704 of guitar case 702. The length of flexible magnet may vary and be, for example, about 10 inches. Flexible magnet 706 has an adhering surface, such as an adhesive surface, for adhering it to outside surface 704. Before it is applied, a removable backing sheet formed over the adhering surface of flexible magnetic body 706 is removed. A plurality of guitar picks 708 with magnetically receptive material may be magnetically held by this flexible magnetic body 706, and thus attached to guitar case 702. The magnetic forces of the guitar pick holding system are sufficiently strong such that guitar picks 708 are normally held to flexible magnetic body 706 even when guitar case 702 is carried by a user or shaken. Flexible magnetic body 706 may have additional suitable qualities and characteristics as other flexible magnetic bodies described above in relation to FIGS. 1–5.

It is well-known that many guitar cases (especially hard-shell guitar cases) come equipped with a guitar case compartment 710, commonly used to store various guitar accessories (guitar picks, guitar strings, etc.). An alternative placement or guitar pick holding system is shown in FIG. 7. A flexible magnetic body 712 may be adhered (e.g. adhesively attached) inside of guitar case 702, preferably on or within guitar case compartment 710, for magnetically carrying a plurality of guitar picks 714. For example, flexible magnetic body 712 may be adhered to an outside or inside surface of a hinged door of guitar case compartment 710. Before flexible magnetic body 712 is applied, a removable backing sheet formed over the adhering surface is removed. Flexible magnetic body 712 may have additional suitable qualities and characteristics as other flexible magnetic bodies described above in relation to FIGS. 1–5.

Figure 8:
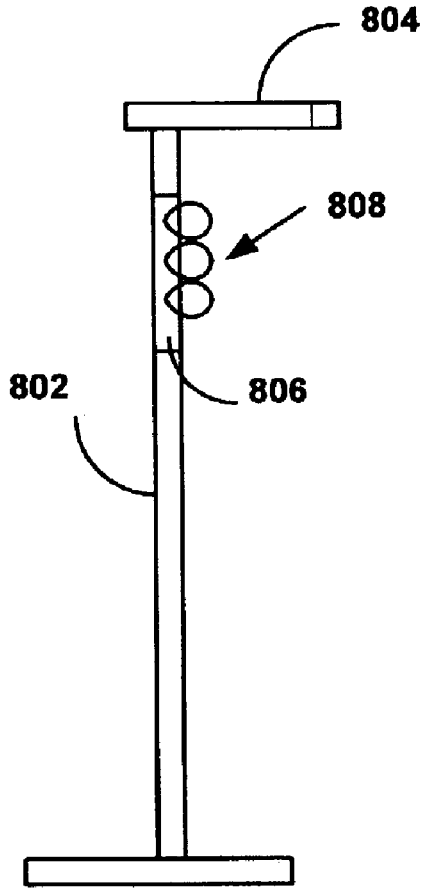
FIG. 8 is an illustration of a microphone stand for carrying a microphone, where the microphone stand includes a flexible magnet adhered thereto.

FIG. 8 is an illustration of a guitar pick holding system for a microphone stand 802 which is configured to carry a microphone 804. Microphone stand 802 typically has at least one metal rod. Similar to those teachings described above, a flexible magnetic body 806 is adhered to the metal rod of microphone stand 802. In one embodiment, flexible magnetic body 806 may be attached around most if not all of a circular perimeter of the metal rod of microphone stand 802. In this case, the width of flexible magnetic body 806 is preferably equal to the circular perimeter of a standard microphone rod. The length of flexible magnet 806 may vary and be, for example, about 10 inches. However, any suitable length, such as any length between 4 and 15 inches, may be appropriate. Flexible magnetic body 806 has an adhering surface, such as an adhesive surface, or alternatively a magnetic surface for attaching to the rod of microphone stand 802. In the latter case, flexible magnetic body 806 has a front magnetic surface for holding guitar picks and a rear magnetic surface for magnetically adhering to microphone stand 802. Also for this latter case, flexible magnetic body 806 is sufficiently flexible such that it adheres arcuately around a portion of the metal rod of microphone stand 802. Thus, a plurality of guitar picks 808 with magnetically receptive material may be magnetically held by this flexible magnetic body 806, and thus attached to microphone stand 802.

Thus, from FIGS. 7 and 8, a guitar pick holder includes a flexible magnet; a rear adhering surface of the flexible magnet for use in adhering the flexible magnet to a surface of one of a guitar case and a microphone stand; and a front magnetic surface of the flexible magnet for use in magnetically holding a magnetically receptive guitar pick. The rear adhering surface of the flexible magnet may include an adhesive layer for adhesively adhering to an inside or outside surface of a guitar case or to a microphone stand.

Alternatively, the rear adhering surface of the flexible magnet may include a magnetic field for magnetically adhering to the microphone stand.

Guitar picks. Referring back to FIG. 1, a guitar pick 110 primarily made from a synthetic material (e.g. a plastic, nylon, delrin, tortex, celluloid, acetal, etc.) but having a magnetically receptive material 112 is shown. Magnetically receptive material 112 may be or include, for example, a magnetically receptive metal (e.g. iron, nickel, or cobalt, or combination and/or alloy thereof) or may be a magnetic material. Metal alloys or blends of suitable materials may be utilized.

If magnetically receptive material 112 is formed on each surface of guitar pick 110, it preferably is sized to fit within the perimeter of a standard-sized guitar pick. Preferably, magnetically receptive material 112 has the same shape as guitar pick 110 but its perimeter is contained within and slightly smaller than that of guitar pick 110. Also, the surface of magnetically receptive material 112 preferably includes a coloring and a brand name, visual design, company name, or company logo. The surface may be more personalized as well, providing for a band name, a band logo, a band player's name, or other. Preferably, magnetically receptive material 112 is opaque and is sized to entirely cover up any other distracting text or graphics which may exist the guitar pick itself. In alternative embodiments, magnetically receptive material 112 is shaped in a thin ring or oval, a thin straight line (horizontal or vertical), a cross, or other different shapes, as some examples. In other alternate embodiments, the shape of magnetically receptive material 112 actually forms the design, logo, or name.

In one embodiment, magnetically receptive material 402 is embodied on or within a "sticker" which is adhesively attached onto each surface of guitar pick 110. Each guitar pick sticker includes a magnetically receptive material, such as a thin film of metal, metal alloy, or other suitable material. Each guitar pick sticker may be adhesively attached to one side of guitar pick 110, and preferably guitar pick 110 has one sticker for each surface thereof. Guitar pick 110 may be provided with such material already adhesively attached on each surface thereof. Alternatively, each guitar pick sticker may be peelably removed from a backing sheet and adhered to a guitar player's own preferred guitar picks.

Each guitar pick sticker is sized to fit within the perimeter of a standard-sized guitar pick, and preferably includes a brand name, visual design, company name, or company logo (see guitar pick 110 of FIG. 1). The stickers may be more personalized as well, providing for a band name, a band logo, a band player's name, or other. Preferably, the guitar pick sticker is opaque and is sized to entirely cover up any other distracting text or graphics which may exist the guitar pick itself. In alternative embodiments, each guitar pick sticker is shaped in a thin ring or oval, a thin straight line (horizontal or vertical), or a cross, as examples. In the preferred embodiment, the adhesive used on each guitar pick sticker is acrylic or an acrylic-based adhesive. Each guitar pick sticker also has a thin protective coating (e.g. a gloss or other suitable coating layer) formed over text (or graphic) and the magnetically receptive material, so as to reduce the adverse affect from oils and acids from fingers of the guitar player.

The guitar pick stickers may be made from metal paper, which is a blend of paper material and metal material. This metal paper may be made ink-jet compatible and printed on with a coloring, design, or text. Alternatively, the material may be a blend of metal material and vinyl. As another alternative, a piece of thin magnetic sheeting may be adhered to each side of a guitar pick. Such materials, with or without an adhering backing surface or other laminate, may be obtained from a suitable manufacturer or company such as from Magnetic Specialty, Inc. previously mentioned. This company provides materials suitable for the present application, including JetSTEEL™ material (0.11 mm or 0.0045 inches in thickness), PaperSTEEL™ material (0.254 mm or 0.010 inches in thickness, or 0.635 mm or 0.025" in thickness), ProMAG™ sheet material (0.3 mm or 0.012 inches in thickness), 0.4 mm or 0.015 inches in thickness, 0.5 mm or 0.020 inches in thickness, etc.), and others. JetSTEEL™, PaperSTEEL™, and ProMAG® are trademarks of Magnetic Specialty, Inc.

It has been determined that, using a ProMAG® magnetic sheet having a thickness of 0.30 mm (0.012 inches) (PSA= 1016) to form a flexible guitar magnet, and using a medium thickness synthetic guitar pick having a small piece of PaperSTEEL™ material adhesively attached to each surface thereof (surface area of each piece equal to about 80% of pick surface area), sufficient magnetic properties are present such that the guitar pick can be magnetically held to the flexible magnet. In addition, the guitar pick normally remains held even when the guitar is subject to typical forces of accelerative motion in this particular environment (i.e. when the guitar is physically handled and shaken). By "normally", it is meant that at least 80% of the time the guitar pick remains held to the guitar when subjected to such forces. In fact, with use of the above materials it has been found that the success rate is much higher than 80%, perhaps around 95%. Shaped with the preferred dimensions, this flexible magnet also provides a magnetic field which does not adversely affect any guitar electronics. Of course, a wide range of other types of sufficient materials, material thicknesses, and material properties may be used to achieve these same results as one skilled will readily understand.

It has also been determined that, by providing a metal layer on a plastic surface of guitar pick 110, the metal layer's thickness in combination with its distance from the perimeter edges of guitar pick 110 may cause a tendency of guitar pick 110 to be tilted such that it falls off guitar body 102. In particular, if a guitar player's finger accidentally or intentionally depresses the edge of guitar pick 110 while it rests flat on flexible magnet 114, guitar pick 110 may be tilted such that the metal layer surface loses physical contact and magnetic attraction with the front magnetic surface of flexible magnet 114. This problem may be avoided by forming guitar pick 110 with slight depressions each surface, where each depression is sized to fit the metal layer and has a depth that is about equal to the thickness of the metal layer. Preferably, the thin metal layers each have a top surface that is substantially flush with the top surface of the synthetic material. Thus, if guitar pick 110 is generally 0.8 mm in thickness and the metal layers are 0.25 mm in thickness, guitar pick 110 may be formed with depressions of about 0.25 mm deep on each surface within which the metal layers are formed. The synthetic material in the center of guitar pick 110 would therefore be about 0.3 mm in thickness. To otherwise reduce the occurrence of the aforementioned problem, alternatively the metal layers may be formed on each surface of guitar pick 110 so as to fully extend around the outside perimeter of guitar pick 110, with the exception that the plastic tip of guitar pick 110 would be exposed and without the metal layer.

Preferably, a vinyl layer (e.g. sticker) with a holographic image is provided over the metal paper described above and die cut into appropriate shapes, to form guitar pick stickers.

In an alternate embodiment, the vinyl layer with the holographic image is provided without the metal paper and die cut into appropriate shapes, to form guitar pick stickers which are not magnetically receptive. These "stickers" or films are provided either on the guitar picks directly or on sticker backing sheets for users to peel off and apply themselves.

Other techniques may be used to provide magnetically receptive material 112 on each surface of guitar pick 110. In another embodiment, for example, magnetically receptive material 112 on guitar pick 110 is an electroplated material. This electroplated magnetically receptive material may be applied to each of the two surfaces of guitar pick 110. In yet another alternate embodiment, magnetically receptive material 112 is an electroless plated magnetically receptive material. This electroless plated magnetically receptive material may be applied to each of the two surfaces of guitar pick 110. Preferably, however, magnetically receptive material 112 is formed from an electroplating process which is preceded by an electroless plating process.

Electroplating is a method of coating a surface of an object with a metal. Electroplates are applied by immersing the object to be coated into a tank containing the proper chemicals dissolved in water. If nickel is being applied to the object, for example, nickel metal is one of the components of that solution. The part to be plated is attached to a negative electrical lead and called a cathode. The other electrical lead, the positive lead, is in the solution. When current is applied, the negatively charged part to be plated attracts positively charged metal from the solution, as opposites forces attract. This continues as long as the current is applied, where the coating or deposit becomes thicker and thicker. Most electroplates are not very thick; 1/1000 of an inch (0.001 inch) is regarded as fairly thick. Since metal is being taken from the solution, it must be replenished. Often this is done by "hanging" pieces of the metal in the solution. These pieces of metal are called anodes and the positive electrical lead is attached to them; they dissolve in the solution as metal is taken away by the plating.

However, a guitar pick cannot be electroplated in the same fashion as metals are because plastic is not electrically conductive. That is, one cannot merely immerse a guitar pick connected to a negative lead and expect it to plate. Instead, electroless plating is first used to get a conductive surface on each side of the guitar pick, then the guitar pick is electroplated. Thus, a preplating process which involves electroless plating is performed prior to electroplating the guitar pick. A typical preplating process includes the steps of etching, neutralizing, catalyzing, acceleration, and electroless plating. During etching, an etch bath which consists of a highly concentrated acid solution of chromic and sulfuric acid may be used. This solution oxidizes selective areas on the guitar pick. The holes produced by the oxidizing action are absorbing sites that hold small metallic particles that serve as activators for electroless plating. The hole size influences adhesion and other physical properties. After etching, the guitar pick may be thoroughly rinsed. During the neutralization (or sensitizing) step, a neutralizing bath containing mild acids or alkaline solutions is used to chemically neutralize the acids from the etching bath. During the catalyzing step, a catalytic film is put on the oxidized surface to prepare for electroless metal disposition. During the acceleration step, an accelerator bath removes all the chemicals that remain after the catalyzing procedure. It also accelerates the catalyzic film, to ensure a rapid coverage of electroless deposits. During the electroless plating step, a plating bath of chemicals are used (without current) to deposit a thin metallic film on each side of the guitar pick. The film can be made of nickel or copper or other magnetically receptive material, for example.

Even other processes may be used to form magnetically receptive material 112 on each surface of guitar pick 110. For example, magnetically receptive material 112 may be embodied in a hot foil stamp. Such a hot foil stamp may be applied to each of the two surfaces of guitar pick 110. Most conventional foils used for hot stamping include five different layers: a polyester film carrier which is used to protect the foil layers and to permit rolling; a release coat which allows the other layers to release from the film carrier upon application of heat and/or pressure; a lacquer or color coat which carries the color tint in the form of dyes or pigments (most often this layer is transparent or translucent which allows the introduction of the metallic layer in metal foils); a metal coat which provides the reflective qualities and opacity desired in metallic foils; and an adhesive coat which serves to bond the foil to the substrate being stamped. However, different foil manufacturers produce a number of foils which vary widely. Different foils have different characteristics in terms of durability, scratch resistance, fade resistance, chemical resistance, brittleness, opacity, adherence, along with color and surface characteristics. The metal coat of most foils is typically an aluminum layer but, in this application, the aluminum layer is replaced with a magnetically receptive layer such as a layer of iron or other suitable material. In this embodiment, the coloring of the hot foil stamp is provided by the lacquer or color coat; however, the coloring of the hot foil stamp may be alternatively provided by a printing process which may also provide a trademark name or logo on the surface. As an alternative to hot foil stamping, a cold foil stamp may be utilized.

In even another embodiment, magnetically receptive material 112 may be a physical or chemical vapor deposited material. In this case, the physical or chemical vapor deposited material is applied to each of the two surfaces of guitar pick 110.

In contrast to the embodiments described above, where the magnetically receptive material is formed on each surface of guitar pick 110, the magnetically receptive material may be alternatively "blended" in with the synthetic material. This may be done, for example, using a metal injection molding (MIM) process. MIM represents the merging of two established technologies: injection molding and powdered metal. The basic metal injection molding procedure involves blending a polymer with an extremely fine (e.g. 10–20 micrometer) metal powder. The blended material is injection molded using the same type of equipment and tools employed by the plastics industry. The result combines the strength and durability of metal with the flexibility of injection molding.

Thus, in this particular embodiment, guitar pick 110 may be formed using a metal injected molded (MIM) technique which includes a magnetically receptive material. As an alternative, a magnetic material may be utilized if desired. The polymer used in the MIM process is preferably a similar or the same material conventionally used to make a synthetic guitar pick (nylon, delrin, tortex, celluloid, acetal, etc.). Such guitar picks may be manufactured using metal injection molding to form each guitar pick, or by die cutting guitar picks from extruded sheets. During injection molding, picks are formed by melting the material into liquid form and forcing it into molds the shape of the desired pick. Some plastics, such as celluloid, cannot be molded. Molding produces a material where the fibers are arranged in a random matrix. Unless processed further, the surface of a molded pick is typically shiny and smooth. On the other hand, oftentimes plastics are extruded (force shaped) into sheets or strips. From these extruded sheets, knife-like dies are used to stamp out the various pick shapes. The resulting pick shape must then be tumbled (in rock polishing-like tumblers) to smooth and round the edges. The extruding process sets up a grain with the fibers running in one direction. Many believe that this grain adds to a guitar pick's stiffness and durability. Acetal (Delrin) may be either injection molded or extruded. Nylon is most popular in the molded form, but can also be extruded.

In one final embodiment, guitar picks may be made using a hybrid processing technique involving both a metal forming process and a plastic injection molding process. After the simple shaping of a small magnetically receptive metal plate, it is inserted into a mold. After the mold is closed, plastic is injection molded around it. After cooling, the finished molding is removed from the machine. This production process can be automated and enables the manufacture of components of high quality on an industrial scale. Preferably, the metal sheet is smaller than the size of the guitar pick and is entirely contained within it. Alternatively, portions of the metal plate may be exposed (e.g. at the guitar pick tip, or at the center of the guitar pick) from the plastic mold.

Final Comments. Advantageously, guitar picks can be magnetically carried on a guitar or other object for storage or for easy retrieval by a guitar player while playing. A guitar pick holder of the present application includes a flexible magnet having a front magnetic surface for use in magnetically holding a magnetically receptive guitar pick and a rear adhering surface for use in adhering the flexible magnet to a surface of a guitar. The flexible magnetic body is preferably thin, flat, and formed into a decorative shape to provide a visually appealing design for the guitar. A layer of printed text, design, and/or coloring may be formed over the front magnetic surface. The printed layer could be formed directly on the front magnetic surface or formed on a layer of paper or vinyl which covers the front magnetic surface. The rear adhering surface is preferably a static cling vinyl surface; in other embodiments, however, it may be an adhesive surface or a magnetic or metal surface which is magnetically receptive. A removable backing sheet may cover the rear adhering surface but be removed before the use of the flexible magnet. The magnetic forces provided by the flexible magnet are sufficiently large enough to magnetically hold guitar picks (e.g. even when the guitar is shaken), but also sufficiently small enough so as to not interfere with any electronics used in connection with the guitar. Also advantageously, the guitar pick holder does not detract from the appearance of the guitar or guitar pick, and may in fact be cosmetically appealing (e.g. FIGS. 2 and 5).

It is to be understood that the above is merely a description of preferred embodiments of the invention and that various changes, alterations, and variations may be made without departing from the true spirit and scope of the invention as set for in the appended claims. The guitar utilized may be an acoustic or an electrical guitar, which may be a 6-string electric guitar or a bass guitar. The flexible magnet may be integrally formed using a less flexible plastic (or larger quantities of plastic) to become a relatively harder and more rigid (but still flexible) magnetic body. In addition, each of the embodiments described herein may all be "reversed" such that the flexible body is integrally provided with the magnetically receptive material (e.g. metal such as iron, nickel, cobalt, etc.) and the guitar pick is provided with the magnetic material (within it or on each surface). Few if any of the terms or phrases in the specification and claims have been given any special particular meaning different from their plain language meaning, and therefore the specification is not to be used to define such terms in an unduly narrow sense.

What is claimed is:

1. A guitar pick holder, comprising:

a flexible magnet;

the flexible magnet being made of a soft flexible rubber or plastic;

the flexible magnet having-a front magnetic surface for use in magnetically holding a magnetically receptive guitar pick; and the flexible magnet having a rear adhering surface comprising a repositionable adhesive for use in repositionably adhering the flexible magnet to a surface of a guitar, such that the guitar pick holder is removable, reapplicable, and repositionable over the surface.

2. The guitar pick holder of claim 1, further comprising:

a layer of printed ink conveying a graphics image, band logo, or company logo formed over the front magnetic surface; and wherein a magnetic field for holding the magnetically receptive guitar pick against the front magnetic surface is provided through the layer of printed ink conveying the graphics image, band logo, or company logo.

3. The guitar pick holder of claim 1, wherein the guitar pick holder conveys a company or band logo on its front magnetic surface.

4. The guitar pick holder of claim 1, wherein the guitar pick holder conveys a printed graphics image on its front magnetic surface.

5. The guitar pick holder of claim 1, wherein the flexible magnet has sufficient flexibility to conform and adhere to a non-planar surface of the guitar.

6. The guitar pick holder of claim 1, wherein the flexible magnet has a thickness of 1 millimeter or less and a sufficient flexibility to conform and adhere to a non-planar surface of the guitar.

7. The guitar pick holder of claim 1, further comprising:

a removable backing sheet provided on the rear adhering surface.

8. The guitar pick holder of claim 1, further comprising:

a layer of printed ink or material which is formed over the front magnetic surface.

9. The guitar pick holder of claim 1, further comprising:

wherein the front magnetic surface has a surface area which is sized to hold at least three magnetically receptive guitar picks.

10. The guitar pick holder of claim 1, further comprising:

wherein the front magnetic surface is flat;

wherein the flexible magnet has a thickness of 1 millimeter or less; and wherein a magnetic field over the front magnetic surface is sufficient such that the guitar pick normally remains held against the flexible magnet when the guitar body is shaken.

11. The guitar pick holder of claim 1, wherein the front magnetic surface of the flexible magnet is sufficiently flat such that the guitar pick can be slid off for removal.

12. The guitar pick holder of claim 1, further comprising:

a printed visual design formed over the front magnetic surface of the flexible magnet.

13. The guitar pick holder of claim 1, further comprising:

wherein the flexible magnet has a thickness of 1 millimeter or less.

14. The guitar pick holder of claim 1, further comprising:

wherein the flexible magnet has a thickness of 0.5 millimeters or less.

15. The guitar pick holder of claim 1, wherein the flexible magnet forms one of a lightning bolt, an S-shape, a Z-shape, an arc, an ellipse, a star, an arrow, a cross, a diamond, and a footprint.

16. The guitar pick holder of claim 1, wherein the flexible magnet is die-cut into a decorative shape.

17. The guitar pick holder of claim 1, wherein the flexible magnet has an edge formed with an arcuate shape to conform to both top and bottom arcuate corners of a front surface of an acoustic guitar body.

18. The guitar pick holder of claim 1, wherein the flexible magnet comprises a composite material of ferrite magnetic powder and rubber.

19. The guitar pick holder of claim 1, for further use in adhering over a surface of a guitar case.

20. A guitar pick holder, comprising:

a flexible magnetic body;

the flexible magnetic body having a rear static cling vinyl surface for use in adhering the flexible magnetic body to a surface of a guitar; and the flexible magnetic body having a front magnetic surface for use in magnetically holding at least one magnetically receptive guitar pick.

21. The guitar pick holder of claim 20, further comprising:

wherein the flexible magnetic body is made of a composite material of ferrite magnetic powder and rubber;

wherein the front magnetic surface is sufficiently flat such that the guitar pick can be slid off for removal; and wherein the flexible magnetic body and the guitar pick have sufficient magnetic characteristics such that the guitar pick normally remains held against the guitar when the guitar is shaken.

22. The guitar pick holder of claim 20, further comprising:

a layer of printed ink or material conveying a graphics image, band logo, or company logo formed over the front magnetic surface.

23. The guitar pick holder of claim 20, further comprising:

wherein the thickness of the flexible magnetic body is 1 millimeter or less.

24. The guitar pick holder of claim 20, further comprising:

wherein the front magnetic surface of the flexible magnetic body has a surface area which is sized to hold at least three magnetically receptive guitar picks.

25. A decorative design for conveying one of a graphics image, a band logo, and a company logo for a surface of a guitar, comprising:

a flexible magnet made of a soft flexible rubber or plastic;

the flexible magnet having a thickness of less than or equal to 1 millimeter (mm);

a layer of printed ink or material conveying the graphics image, band logo, or company logo formed over the flexible magnet;

the flexible magnet providing a magnetic field for use in magnetically holding a magnetically receptive guitar pick against a front surface of the decorative design; and the flexible magnet having a rear adhering surface which is adapted for repositionably adhering the decorative design to the surface of the guitar, such that the decorative design is removable, reapplicable, and repositionable over the surface.

26. The decorative design of claim 25, wherein the magnetic field for holding the magnetically receptive guitar pick against the front surface of the decorative design is provided through the layer of printed ink or material conveying the graphics image, band logo, or company logo.

27. The decorative design of claim 25, wherein a die-cut decorative shape of the flexible magnet comprises one of a lightning bolt, an S-shape, a Z-shape, an arc, an ellipse, a star, an arrow, a cross, a diamond, and a footprint.

28. The decorative design of claim 25, wherein a die-cut decorative shape of the flexible magnet differs from a square, rectangle, or circle.

29. The decorative design of claim 25, further comprising:

the flexible magnet having sufficient flexibility to conform and adhere to a non-planar surface of the guitar.

30. The decorative design of claim 25, further comprising:

a removable backing sheet formed over the rear adhering surface.

31. A guitar pick holder, comprising:

a flexible magnet made of a flexible rubber or plastic;

the flexible magnet having a thickness of 1 millimeter or less;

a rear adhering surface of the flexible magnet adapted for use in repositionably adhering the flexible magnet over a surface of the guitar, such that the guitar pick holder is removable, reapplicable, and repositionable over the surface; and a front magnetic surface of the flexible magnet for use in magnetically attracting and carrying a magnetically receptive guitar pick.

32. The guitar pick holder of claim 31, further comprising:

a decorative layer adhesively attached over the front magnetic surface of the flexible magnet.

33. The guitar pick holder of claim 31, wherein the rear adhering surface comprises static cling vinyl.

34. The guitar pick bolder of claim 31, wherein the rear adhering surface comprises a repositionable adhesive.

35. The guitar pick holder of claim 31, further comprising:

a printed graphics image formed over the front magnetic surface.

36. The guitar pick holder of claim 31, wherein the rear adhering surface comprises one of a repositionable adhesive and static cling vinyl.

37. The guitar pick holder of claim 31, wherein the front magnetic surface of the flexible magnet has a surface area which is sized to hold at least three magnetically receptive guitar picks.

38. The guitar pick holder of claim 31, further comprising:

a removable backing sheet formed over the rear adhering surface;

the front magnetic surface having a surface area which is sized to hold at least three magnetically receptive guitar picks; and a decorative layer adhesively attached over the front magnetic surface.

39. The guitar pick holder of claim 31, further comprising:

a removable backing sheet formed over the rear adhering surface.

40. The guitar pick holder of claim 31, wherein the flexible magnet comprises a die-cut decorative design for the guitar.

41. A guitar pick comprising a synthetic material and a magnetically receptive material for use with a flexible magnet which has a front magnetic surface for magnetically holding the guitar pick and a rear adhering surface for adhering the flexible magnet to a surface of a guitar, the flexible magnet made of a soft flexible rubber or plastic having a thickness of 1 millimeter or less which is sufficiently flexible to conform to a non-planar surface of the guitar, the magnetically receptive material of the guitar pick being sufficient such that when the guitar pick is magnetically held against the front surface of the flexible magnet on the guitar, it normally remains held when the guitar is shaken.

42. The guitar pick of claim 41 wherein a layer of material having a printed graphics image is formed over the flexible magnet.

43. The guitar pick of claim 41, wherein the magnetically receptive material of the guitar pick comprises metal.

44. The guitar pick of claim 41, wherein the magnetically receptive material of the guitar pick comprises at least one of iron, cobalt, and nickel.

45. The guitar pick of claim 41, wherein the magnetically receptive material of the guitar pick is formed over a surface of the guitar pick.

* * * * *